US006950799B2

(12) United States Patent
Bi et al.

(10) Patent No.: US 6,950,799 B2
(45) Date of Patent: Sep. 27, 2005

(54) SPEECH CONVERTER UTILIZING PREPROGRAMMED VOICE PROFILES

(75) Inventors: Ning Bi, San Diego, CA (US); Andrew P. DeJaco, San Diego, CA (US)

(73) Assignee: Qualcomm Inc., San Diego, CA (US)

( * ) Notice: Subject to any disclaimer, the term of this patent is extended or adjusted under 35 U.S.C. 154(b) by 622 days.

(21) Appl. No.: 10/080,059

(22) Filed: Feb. 19, 2002

(65) Prior Publication Data

US 2003/0158728 A1 Aug. 21, 2003

(51) Int. Cl.[7] ..... G10L 13/00; G10L 11/00
(52) U.S. Cl. ..... 704/261; 704/262; 704/269
(58) Field of Search ..... 704/200, 203, 704/205, 207, 209, 219, 258, 261, 262, 266, 268, 269

(56) References Cited

U.S. PATENT DOCUMENTS

| | | | | | |
|---|---|---|---|---|---|
| 5,750,912 | A | * | 5/1998 | Matsumoto | 84/609 |
| 5,911,129 | A | | 6/1999 | Towell | |
| 5,915,237 | A | * | 6/1999 | Boss et al. | 704/270.1 |
| 5,933,805 | A | * | 8/1999 | Boss et al. | 704/249 |
| 6,260,009 | B1 | | 7/2001 | Dejaco | |
| 6,289,085 | B1 | * | 9/2001 | Miyashita et al. | 379/88.02 |
| 6,336,092 | B1 | * | 1/2002 | Gibson et al. | 704/268 |
| 6,411,933 | B1 | * | 6/2002 | Maes et al. | 704/273 |
| 6,789,066 | B2 | * | 9/2004 | Junkins et al. | 704/500 |
| 6,810,378 | B2 | * | 10/2004 | Kochanski et al. | 704/258 |
| 2001/0051874 | A1 | | 12/2001 | Tsuji | |

FOREIGN PATENT DOCUMENTS

| | | |
|---|---|---|
| EP | 1006511 | 6/2003 |

OTHER PUBLICATIONS

Verma et al., "Articulatory class based spectral envelope representation," 2004 IEEE International Conference on Multimedia and Expo, 2004. ICME '04, Jun. 27–30, 2004, vol. 3, pp. 1647 to 1650.*
L.C. Schwardt et al., Voice Conversion Based On Static Speaker Characteristics, IEEE 1998, pp. 57–62.
Masanobu Abe et al., Voice Conversion Through Vector Quantization, IEEE 1998 pp. 655–658.

* cited by examiner

*Primary Examiner*—Martin Lerner
(74) *Attorney, Agent, or Firm*—Philip R Wadsworth; Charles D Brown; George C Pappas

(57) ABSTRACT

A speech processing system modifies various aspects of input speech according to a user-selected one of various preprogrammed voice fonts. Initially, the speech converter receives a formants signal representing an input speech signal and a pitch signal representing the input signal's fundamental frequency. One or both of the following may also be received: a voicing signal comprising an indication of whether the input speech signal is voiced, unvoiced, or mixed, and/or a gain signal representing the input speech signal's energy. The speech converter also receives user selection of one of multiple preprogrammed voice fonts, each specifying a manner of modifying one or more of the received signals (i.e., formants, voicing, pitch, gain). The speech converter modifies at least one of the formants, voicing, pitch, and/or gain signals as specified by the selected voice font.

30 Claims, 4 Drawing Sheets

SPEECH CONVERTER UTILIZING PREPROGRAMMED VOICE PROFILES

BACKGROUND OF THE INVENTION

1. Field of the Invention

The present invention relates to speech processing, and more particularly, to a speech converter that modifies various aspects of a received speech signal according to a user-selected one of various preprogrammed profiles.

2. Description of the Related Art

Speech conversion is a technology to convert one speaker's voice into another's, such as converting a male's voice to a female's and vice versa. Speech conversion systems are a new concept, most of which are still in the research phase. The SOUNDBLASTER software package by Creative Technology Ltd., which runs on a personal computer, is one of few known sound effect products that can be used to modify speech. This product utilizes an input signal comprising a digitized analog waveform in wideband PCM form, and serves to modify the input signal in various ways depending upon user input. Some exemplary effects are entitled female to male, male to female, Zeus, and chipmunk.

Although products such as these are useful for some applications, they are not quite adequate when considered for use in more compact applications than personal computers, or when considered for applications requiring more advanced modes of speech conversion. Namely, personal computers offer abundant memory, wideband sampling frequency, enormous processing power, and other such resources that are not always available in compact applications such as wireless telephones. Depending upon the desired complexity of conversion, it can be challenging or impossible to develop speech conversion systems for applications of such compactness.

An additional problem with known speech modification software is the converted speech does not always sound natural. Although the reason for this may not be unknown to others, the present inventor has discovered that the problems lies in the application of the same conversion to speech qualities such as pitch and formants.

Consequently, known speech conversion systems are not always completely adequate for all applications due to certain unsolved problems.

SUMMARY OF THE INVENTION

Broadly, the present invention concerns a method of speech conversion that modifies various aspects of input speech as specified by a user-selected one of various preprogrammed profiles ("voice fonts"). Initially, a speech converter receives signals including a formants signal representing an input speech signal and a pitch signal representing the input signal's fundamental frequency. Optionally, one or both of the following may be additionally received: a voicing signal comprising an indication of whether the input speech signal is voiced or unvoiced or mixed, and/or a gain signal representing the input signal's energy. The speech converter also receives user selection of one of multiple voice fonts, each specifying a manner of modifying one or more of the received signals (i.e., formants, voicing, pitch, gain). For instance, different voice fonts may prescribe signal modification to create a monotone voice, deep voice, female voice, melodious voice, whisper voice, or other effect. The speech converter modifies one or more of the received signals as specified by the selected voice font.

The invention affords its users with a number of distinct advantages. For example, the invention provides a speech converter that is compact yet powerful in its features. In addition, the speech converter is compatible with narrowband signals such as those utilized aboard wireless telephones. Another advantage of the invention is it can separately modify speech qualities such as pitch and formants. This avoids unnatural speech produced by conventional speech conversion packages that apply the same conversion ratio to both pitch and formants signals.

The invention also provides a number of other advantages and benefits, which should be apparent from the following description of the invention.

DETAILED DESCRIPTION

The nature, objectives, and advantages of the invention will become more apparent to those skilled in the art after considering the following detailed description in connection with the accompanying drawings.

Hardware Components & Interconnections

Overall Structure

Figure 1:
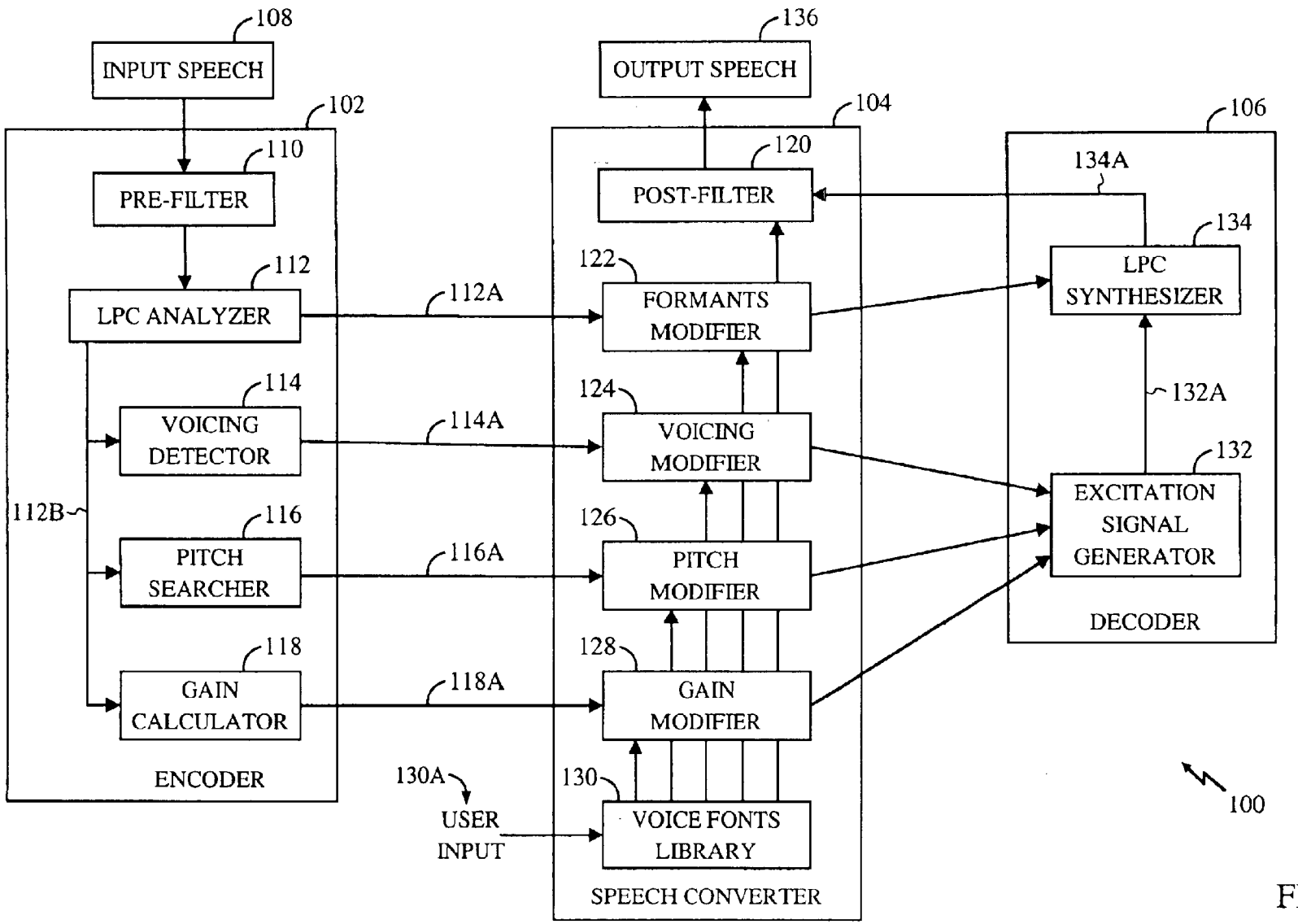
FIG. 1 is a block diagram of the hardware components and interconnections of a speech processing system.

One aspect of the invention concerns a speech processing system, which may be embodied by various hardware components and interconnections, with one example being described by the speech processing system 100 shown in FIG. 1. The speech processing system 100 includes various subcomponents, each of which may be implemented by a hardware device, a software device, a portion of a hardware or software device, or a combination of the foregoing. The makeup of these subcomponents is described in greater detail below, with reference to an exemplary digital data processing apparatus, logic circuit, and signal bearing medium.

Broadly, the system 100 receives input speech 108, encodes the input speech with an encoder 102, modifies the encoded speech with a speech converter 104, decodes the modified speech with a decoder 106, and optionally modifies the decoded speech again with the speech converter 104. The result is output speech 136.

Unlike prior products such as the SOUNDBLASTER software package, the system 100 employs the speech production model to describe speech being processed by the system 100. The speech production model, which is known in the field of artificial speech generation, recognizes that speech can be modeled by an excitation source, an acoustic filter representing the frequency response of the vocal tract, and various radiation characteristics at the lips. The excitation source may comprise a voiced source, which is a quasi-periodic train of glottal pulses, an unvoiced source, which is a randomly varying noise generated at different places in the vocal tract, or a combination of these. An all pole infinite impulse response filter models the vocal tract transfer function, in which the poles are used to describe resonance frequencies or formant frequencies of the vocal tract. For each individual, the excitation source can be distinguished because of the fundamental frequency of voiced speech. The formant frequencies can be distinguished because of geometrical configuration of the vocal tract. In order to modify formants and pitch independently, the present invention separates formants and pitch in the encoder, which is designed based on the speech production model.

The encoder 102 and decoder 106 may be implemented utilizing teachings of various commercially available products. For instance, the encoder 102 may be implemented by various known signal encoders provided aboard wireless telephones. The decoder 106 may be implemented utilizing teachings of various signal encoders known for implementation at base stations, hubs, switches, or other network facilities of wireless telephone networks. Each connection formed in digital wireless telephony implements some type of encoder and decoder. Unlike known encoders and decoders, however, the system 100 includes an intermediate component embodied by the speech converter 104, described in greater detail below. Moreover, as described in greater detail below, both encoder and decoder are provided in the same wireless telephone or other computing unit.

Encoder

Referring to FIG. 1 in greater detail, the encoder 102 analyzes the input speech 108 to identify various properties of the input speech including the formants, voicing, pitch, and gain. These features are provided on the outputs 112*a,* 114*a,* 116*a,* and 118*a.* Optionally, the voicing and/or gain signals and subsequent processing thereof may be omitted for applications that do not seek to modify these aspects of speech. The encoder 102 includes a pre-filter 110, which divides the input speech into appropriately sized windows, such as 20 milliseconds. Subsequent processing of the input speech is performed window by window, in the illustrated embodiment. In addition, the pre-filter 110 may perform other functions, such as blocking DC signals or suppressing noise. The LPC analyzer 112 applies linear predictive coding (LPC) to the output of the pre-filter 110. As illustrated, the LPC analyzer 112 and subsequent processing stages process input speech one window at a time. For ease of reference, however, processing is broadly discussed in terms of the input speech and its byproducts. LPC analysis is a known technique of separate source signal from vocal tract characteristics of speech, as taught in various references including the text L. Rabinger & B. Juang, Fundamentals of Speech Recognition. The entirety of this reference is incorporated herein by reference. The LPC analyzer 112 provides LPC coefficients (on the output 112*a*) and a residual signal on outputs 112*b.* The LPC coefficients are features that describe formants.

The residual signal is directed to a voicing detector 114, pitch searcher 116, and gain calculator 118 which provide output signals at respective outputs 114*a,* 116*a,* 118*a.* The components 114, 116, 118 process the residual signal to extract source information representing voicing, pitch, and gain, respectively. In one example, "voicing" represents whether the input speech 108 is voiced, unvoiced, or mixed; "pitch" represents the fundamental frequency of the input speech 108; "gain" represents the energy of the input speech 108 in decibels or other appropriate units. Optionally, one or both of the voicing detector 114 and gain calculator 118 may be omitted from the encoder 102.

Speech Converter

Broadly, the speech converter 104 receives the formants, voicing, pitch, and gain signals from the encoder 102, and modifies one, some, or all of these signals as dictated by a user-selected one of various preprogrammed voice fonts included in a voice fonts library 130. The library 130 may be implemented by circuit memory, magnetic disk storage, sequential media such as magnetic tape, or any other storage media. Each voice font represents a different profile containing instructions on how to modify a specified one or more of formants, voicing, pitch, and/or gain to achieve a desired speech conversion result. Some exemplary profiles are discussed later below.

The library 130 receives user input 130*a* indicating user selection of a desired voice font. The user input 130*a* may be received by an interface such as a keypad, button, switch, dial, touch screen, or any other human user interface. Alternatively, where the user is non-human, the input 130*a* may arrive from a network, communications channel, storage, wireless link, or other communications interface to receive input from a user such as a host, network attached processor, application program, etc.

According to the user-selected input 130*a,* the voice fonts library 130 makes the respective components of the selected voice font available to the formants modifier 122, voicing modifier 124, pitch modifier 126, gain modifier 128, and (as separately described below) post-filter 120. Alternatively, instead of directing the user input 130*a* to the library 130, the user input 130*a* may be directed to the components 122, 124, 126, 128 causing these components to retrieve the desired voice font from the library 130. Each voice font specifies the modification (if any) to be applied by each of the components 122, 124, 126, 128 when that voice font is selected by user input 130*a.*

The formants modifier 122 may be implemented to carry out various functions, as discussed more thoroughly below. In one example, the formants modifier 122 multiplies the LPC coefficients on the line 112*a* by multipliers specified in a matrix that the user selected voice font specifies or contains. In another example, the formants modifier 122 converts the LPC coefficients into the linear spectral pair (LSP) domain, multiplies the resultant LSP pairs by a constant, and converts the LSP pairs back into LPC coefficients. LSP technology is discussed in the above-cited reference to Rabinger and Juang entitled "Fundamentals of Speech Recognition."

The voicing modifier 124 changes the voicing signal 114*a* to a desired value of voiced, unvoiced, or mixed, as dictated by the user selected voice font. The pitch modifier 126 multiplies the pitch signal 116*a* by a ratio such as 0.5, 1.5, or by a table of different ratios to be applied to different syllables, time slices, or other subcomponents of the signal arriving from 116*a.* As another alternative, the pitch modifier 126 may change pitch to a predefined value (monotone) or multiple different predefined values (such as a melody). The gain modifier 128 changes the gain signal 118*a* by multiplying it by a ratio, or by a table of different ratios to be applied over time.

The voice fonts 130 are tailored to provide various pre-programmed speech conversion effects. For example, by modifying pitch and formants with certain ratios, speech may be converted from male to female and vice versa. In some cases, one ratio may be applied to pitch and a different ratio applied to formants in order to achieve more natural sounding converted speech. Alternatively, an accent may be introduced by replacing pitch with predefined pitch intonation patterns, and optionally modifying formants at certain phonemes. As another example, a robotic voice may be created by fixing pitch at a certain value, optionally fixing voicing characteristics, and optionally modifying formants by increasing resonance. In still another example, talking speech may be converted to singing speech by changing pitch to that of a predetermined melody.

Optionally, the speech converter 104 may include a post-filter 120. According to contents of the user-selected voice font from the font library 130, the post-filter 120 applies an appropriate filtering process to signals from the decoder 106 (discussed below). In one embodiment, the post-filter 120 performs spectral slope modification of the decoded speech. As a different or additional function, the post-filter 120 may apply filtering such as low pass, high pass, or active filtering. Some examples include finite impulse response and infinite impulse response filters. One exemplary filtering scheme applies $y(n)=x(n)+x(n-L)$ to generate an echo effect.

Decoder

Generally, the decoder 106 performs a function opposite to the encoder 102, namely, recombining the formants, voicing, pitch, and gain (as modified by the speech converter 104) into output speech. The decoder 106 includes an excitation signal generator 132, which receives the voicing, pitch, and gain signals (with any modifications) from the converter 104 and provides a representative LPC residual signal on a line 132*a*. The structure and operation of the generator 132 may be according to principles familiar to those in the relevant art.

An LPC synthesizer 134, applies inverse LPC processing to the formants from the formants modifier 122 and the residual signal 132*a* from the generator 132 in order to generate a representative speech signal on an output 134*a*. Thus, the synthesizer 134 and generator 132 combinedly perform an inverse function to the LPC analyzer 112. The structure and operation of the synthesizer 134 may be according to principles familiar to those in the relevant art.

In one embodiment, the output 134*a* of the LPC synthesizer 134 may be utilized as the output speech 136. Alternatively, as discussed above and illustrated in FIG. 1, the speech signal 134*a* output by the LPC synthesizer may be routed back to the post-filter 120 and modified as specified by the user selected voice font. In this case, the output of the post-filter 120 becomes the output speech 136 as illustrated in FIG. 1.

Exemplary Digital Data Processing Apparatus

As mentioned above, data processing entities such as the speech processing system 100, or one or more individual components thereof, may be implemented in various forms. One example is a digital data processing apparatus, as exemplified by the hardware components and interconnections of the digital data processing apparatus 200 of FIG. 2.

The apparatus 200 includes a processor 202, such as a microprocessor, personal computer, workstation, or other processing machine, coupled to a storage 204. In the present example, the storage 204 includes a fast-access storage 206, as well as nonvolatile storage 208. The fast-access storage 206 may comprise random access memory ("RAM"), and may be used to store the programming instructions executed by the processor 202. The nonvolatile storage 208 may comprise, for example, battery backup RAM, EEPROM, one or more magnetic data storage disks such as a "hard drive", a tape drive, or any other suitable storage device. The apparatus 200 also includes an input/output 210, such as a line, bus, cable, electromagnetic link, or other means for the processor 202 to exchange data with other hardware external to the apparatus 200.

Despite the specific foregoing description, ordinarily skilled artisans (having the benefit of this disclosure) will recognize that the apparatus discussed above may be implemented in a machine of different construction, without departing from the scope of the invention. As a specific example, one of the components 206, 208 may be eliminated; furthermore, the storage 204, 206, and/or 208 may be provided on-board the processor 202, or even provided externally to the apparatus 200.

Logic Circuitry

In contrast to the digital data processing apparatus discussed above, a different embodiment of the invention uses logic circuitry instead of computer-executed instructions to implement some or all processing entities of the speech processing system 100. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS, TTL, VLSI, or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

Wireless Telephone

Figure 3:
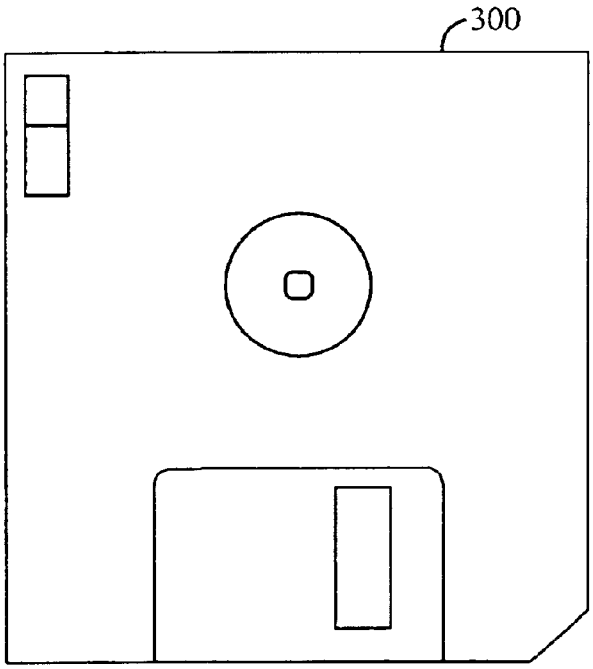
FIG. 3 shows an exemplary signal-bearing medium.
Figure 4:
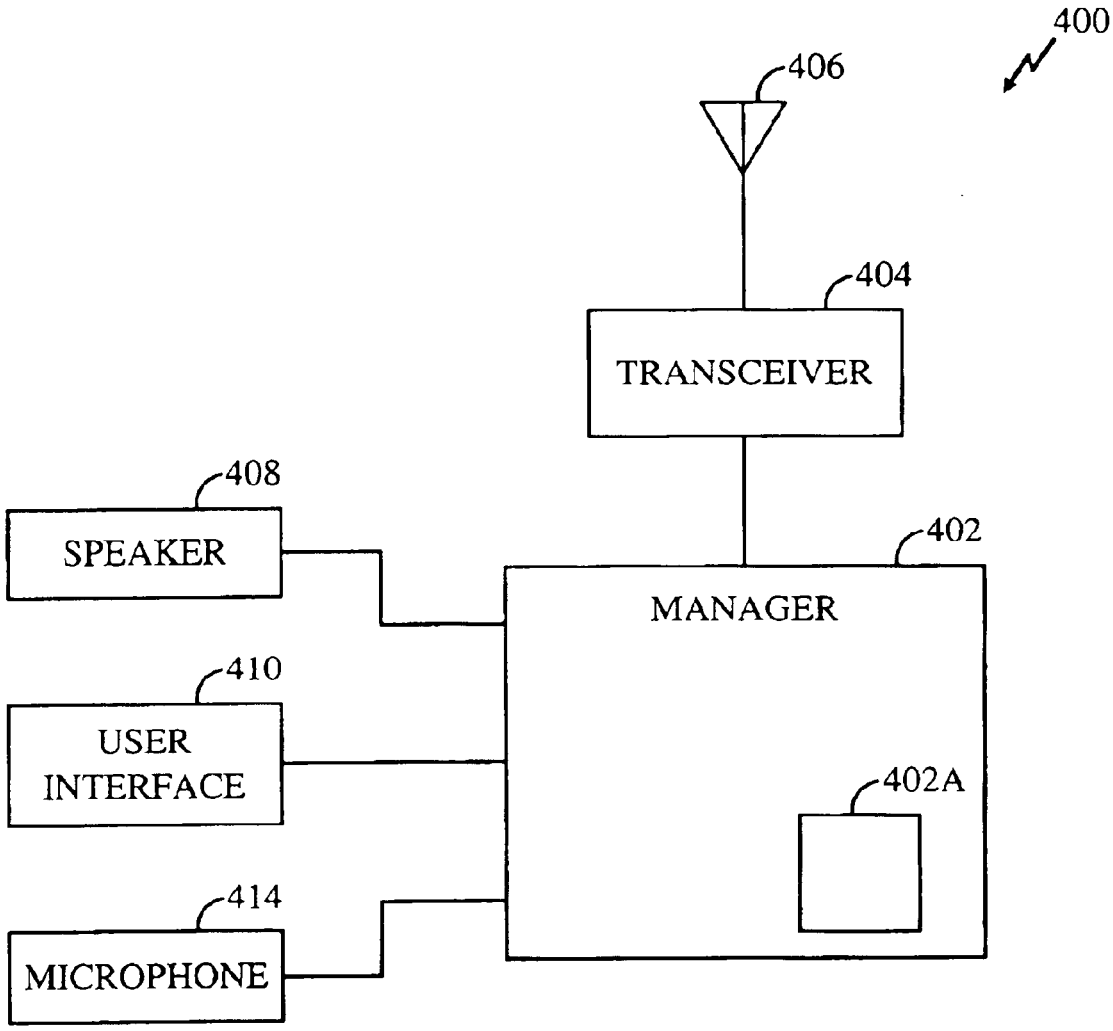
FIG. 4 is a block diagram of a wireless telephone including a speech converter.

In one exemplary application, without any limitation, the speech processing system 100 may be implemented in a wireless telephone 400 (FIG. 4), along with other circuitry known in the art of wireless telephony. The telephone 400 includes a speaker 408, user interface 410, microphone 414, transceiver 404, antenna 406, and manager 402. The manger 402, which may be implemented by circuitry such as that discussed above in conjunction with FIGS. 3–4, manages operation of the components 404, 408, 410, and 414 and signal routing therebetween. The manager 402 includes a speech conversion module 402*a*, embodied by the system 100. The module 402*a* performs a function such a obtaining input speech from a default or user-specified source such as the microphone 414 and/or transceiver 404 and modifying the input speech in accordance with directions from the user received via the interface 410, and providing the output speech to the speaker 408, transceiver 404, or other default or user-specified destination.

As an alternative to the telephone 400, the system 100 may be implemented in a variety of other devices, such as a personal computer, computing workstation, network switch, personal digital assistant (PDA), or any other useful application.

OPERATION

Having described the structural features of the present invention, the operational aspect of the present invention will now be described.

Signal-Bearing Media

Figure 2:
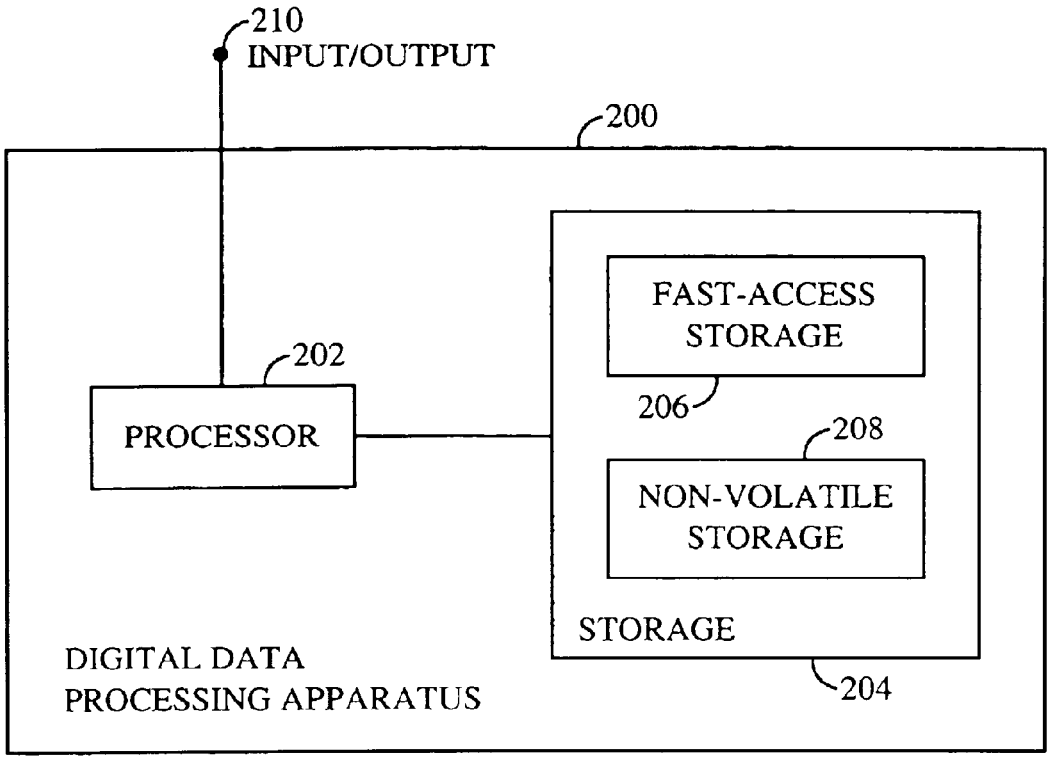
FIG. 2 is a block diagram of a digital data processing machine.

Wherever some functionality of the invention is implemented using one or more machine-executed program sequences, these sequences may be embodied in various forms of signal-bearing media. In the context of FIG. 2, such a signal-bearing media may comprise, for example, the storage 204 or another signal-bearing media, such as a magnetic data storage diskette 300 (FIG. 3), directly or indirectly accessible by a processor 202. Whether contained in the storage 206, diskette 300, or elsewhere, the instructions may be stored on a variety of machine-readable data storage media. Some examples include direct access storage (e.g., a conventional "hard drive", redundant array of inexpensive disks ("RAID"), or another direct access storage device ("DASD")), serial-access storage such as magnetic or optical tape, electronic non-volatile memory (e.g., ROM, EPROM, or EEPROM), battery backup RAM, optical storage (e.g., CD-ROM, WORM, DVD, digital optical tape), paper "punch" cards, or other suitable signal-bearing media including analog or digital transmission media and analog and communication links and wireless communications. In an illustrative embodiment of the invention, the machine-readable instructions may comprise software object code, compiled from a language such as assembly language, C, etc.

Logic Circuitry

In contrast to the signal-bearing medium discussed above, some or all of the invention's functionality may be implemented using logic circuitry, instead of using a processor to execute instructions. Such logic circuitry is therefore configured to perform operations to carry out the method of the invention. The logic circuitry may be implemented using many different types of circuitry, as discussed above.

Overall Sequence of Operation

Figure 5:
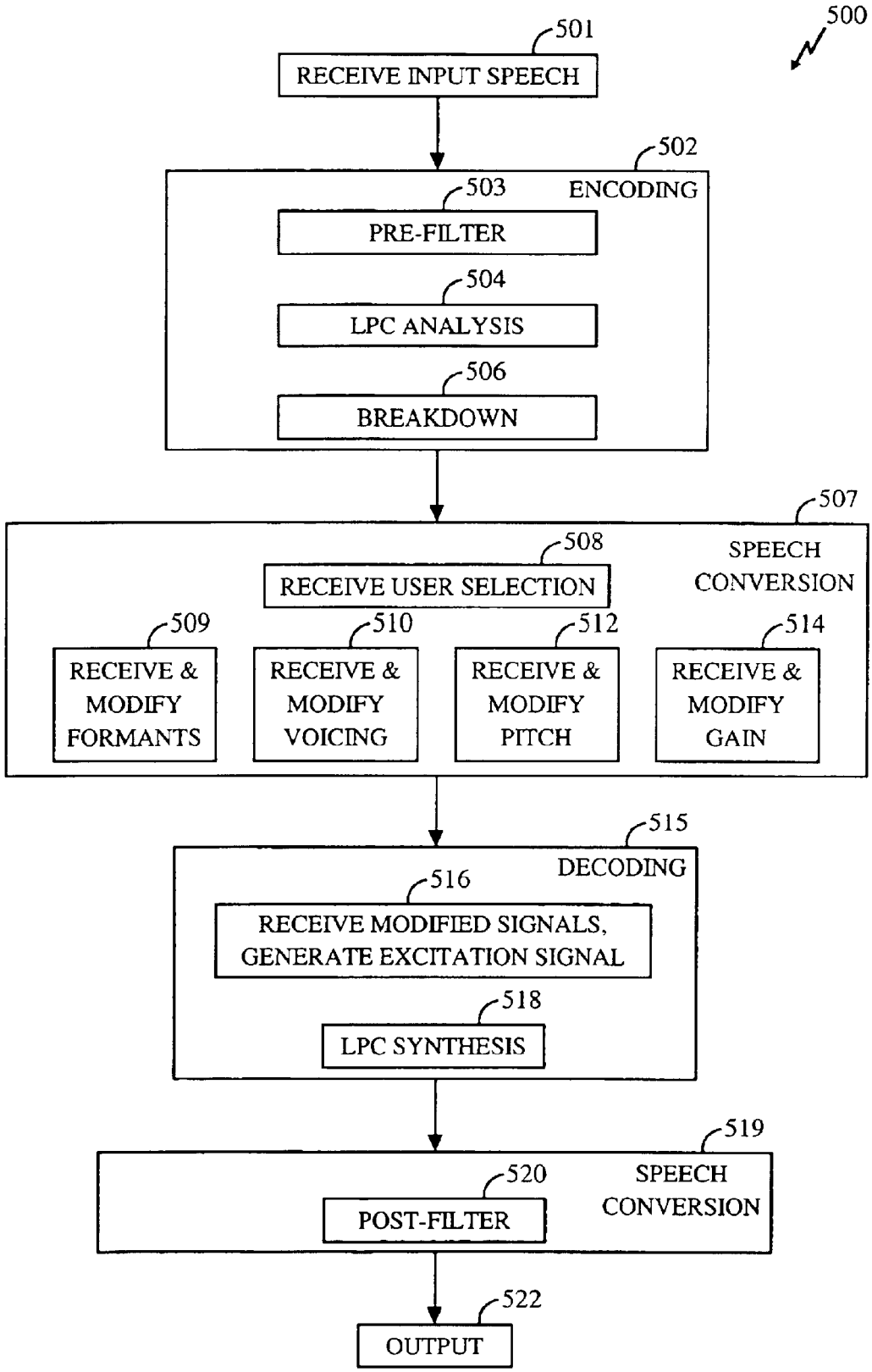
FIG. 5 is a flowchart of an operational sequence for speech conversion by modifying input speech signals as specified by a user-selected one of various preprogrammed profiles.

FIG. 5 shows a speech conversion sequence 500 to illustrate one operational embodiment of the invention. Broadly, this sequence involves tasks of modifying various aspects of a received speech signal according to a user-selected one of various preprogrammed voice fonts. This is accomplished by modifying formants, voicing, pitch, and/or gain of the speech signal as specified by the user-selected voice font. For ease of explanation, but without any intended limitation, the example of FIG. 5 is described in the context of the speech processing system 100 described above.

The sequence 500 is initiated in step 501, when the encoder 102 receives the input speech 108. Next is the encoding process 502. In step 503, the pre-filter 110 divides the input speech into appropriately sized windows, such as 20 milliseconds. Subsequent processing of the input speech is performed window by window, in the illustrated embodiment. In addition, the pre-filter 110 may perform other functions, such as blocking DC signals or suppressing noise. In step 504, the LPC analyzer 112 applies LPC to the output of the pre-filter 110. As illustrated, the LPC analyzer 112 and each subsequent processing stage separately processes each window of input speech. For ease of reference, however, processing is broadly discussed in terms of the input speech and its byproducts. The LPC analyzer 112 provides LPC coefficients (formants) on the output 112*a* and a residual signal on the output 112*b*.

In step 506, the residual signal is broken down. Namely, the LPC analyzer 112 directs the residual signal to the voicing detector 114, pitch searcher 116, and gain calculator 118, and these components provide output signals at their respective outputs 114*a*, 116*a*, 118*a*. The components 114, 116, 118 process the residual signal to extract source information representing voicing, pitch, and gain. In the present example, as mentioned above, "voicing" represents whether the input speech 108 is voiced, unvoiced, or mixed; "pitch" represents the fundamental frequency of the input speech 108; "gain" represents the energy of the input speech 108 in decibels or other appropriate units. Optionally, if one or both of the voicing detector 114 and gain calculator 118 are omitted from the encoder 102, then the functionality of these components as illustrated herein is also omitted.

After step 502, speech conversion occurs in step 507. In step 508, a user selects a voice font from the voice fonts library 130 to be applied by the speech converter 104. Also in step 508, the voice fonts library 130 receives the user input 130*a* and accordingly makes the respective components of the selected profile available to the formants modifier 122, voicing modifier 124, pitch modifier 126, and gain modifier 128. Under one alternative, the user input 130*a* may be directed to the components 122, 124, 126, 128 instead of the library 130, causing these components to retrieve the desired voice font from the library 130. Each voice font specifies a particular modification (if any) to be applied by one or more of the components 122, 124, 126, 128 when that voice font is selected.

Each voice font specifies a manner of modifying at least one of the received signals (i.e., formants, voicing, pitch, gain). The "user" may be a human operator, host machine, network-connected processor, application program, or other functional entity. In steps 509, 510, 512, 514, the components 122, 124, 126, 128 receive and modify their respective input signals 112*a*, 114*a*, 116*a*, 118*a*. Namely, the formants modifier 112 receives a formants signal 112*a* representing the input speech signal 108 (step 509); the voicing modifier 124 receives a voicing signal 114 comprising an indication of whether the input speech signal 108 is voiced, unvoiced, or mixed (step 510); the pitch modifier 126 receives a pitch signal 116*a* comprising a representation of fundamental frequency of the input speech signal 108 (step 512); the gain modifier 128 receives a gain signal 118*a* representing energy of the input speech signal 108 (step 514).

Also in steps 509, 510, 512, 514, the components 122, 124, 126, and/or 128 modify one or more of the received signals 112*a*, 114*a*, 116*a*, 118*a* according to the voice font selected by user input 130*a*. For example, step 509 may involve the formants modifier 122 modifying the formants signal 112*a* by converting LPC coefficients of the input signal to LSPs, modifying the LSPs in accordance with the user-selected voice font, and then converting the modified LSPs back into LPC coefficients. One exemplary technique for modifying the LSPs is shown by Equation 1, below.

$$LSP_{new}(i)=LSP(i)*F*(11-i)/(F+10-i) \quad [1]$$

where:

i ranges from one to ten.

F is a formants shifting factor with a range of 0.5 to 2, depending upon the desired effect of the associated voice font. When F=1, for example, LSPnew(i)=LSP(i) and there is no shifting.

Another technique for shifting formants is expressed by Equation 2, below.

$$LSP_{new}(i)=LSP(i)*F \quad [2]$$

where:

i ranges from one to ten.

F is a desired formants shifting factor.

As an example of step 510, the voicing modifier 124 may involve changing the voicing signal 114*a* so as to change the input speech 108 to a different property of voiced, unvoiced, or mixed. As an example of step 512, the pitch modifier 116 may modify the pitch signal 116*a* by multiplying by a predetermined coefficient (such as 0.5, 2.0, or another ratio), multiplying pitch by a matrix of differential coefficients to be applied to different syllables or time slices or other components, replacing pitch with a fixed pitch pattern of one or more pitches, or another operation. As an example of step 514, the gain modifier 128 may modify the signal 118*a* so as to normalize the gain of the input speech 108 to a predetermined or user-input value.

After speech conversion 507, decoding 515 occurs. In step 516, the excitation signal generator 132 receives the voicing, pitch, and gain signals (with any modifications) from the converter 104 and provides a representative LPC residual signal at 132*a*. Thus, the generator 132 performs an inverse of one function of the LPC analyzer 112. In step 518, the synthesizer 134 applies inverse LPC processing to the formants (from the formants modifier 122) and the residual signal 132*a* (from the generator 132) in order to generate a representative speech output signal at 134*a*. Thus, the synthesizer 134 performs an inverse of one function of the LPC analyzer 112. In one embodiment, the output 134*a* of the LPC synthesizer 134 may be utilized as the output speech 136.

Alternatively, as discussed above, the speech signal 134*a* output by the LPC synthesizer 134 may be routed back for more speech conversion in step 519. Namely, in step 520 the post-filter 120 modifies the LPC synthesizer 134's signal according to the user-selected voice font, in which case the output of the post-alter 120 (rather than the synthesizer 134) constitutes the output speech 136 in step 522. In one embodiment, the post-filter 120 performs spectral slope modification of the output speech. The post-filter 120 may apply filtering such as low pass, high pass, or active filtering. Some examples include a finite impulse response or infinite impulse response filter. A more particular example is a filter that applies a function such as $y(n)=x(n)+x(n-L)$ to generate an echo effect. ps Other Embodiments While the foregoing disclosure shows a number of illustrative embodiments of the invention, it will be apparent to those skilled in the art that various changes and modifications can be made herein without departing from the scope of the invention as defined by the appended claims. Furthermore, although elements of the invention may be described or claimed in the singular, the plural is contemplated unless limitation to the singular is explicitly stated. Additionally, ordinarily skilled artisans will recognize that operational sequences must be set forth in some specific order for the purpose of explanation and claiming, but the present invention contemplates various changes beyond such specific order.

What is claimed is:

1. A method for speech signal conversion, comprising operations of:

receiving signals including:

a formants signal representative of an input speech signal;

a voicing signal comprising an indication of whether the input speech signal is voiced, invoiced, or mixed;

a pitch signal comprising a representation of fundamental frequency of the input speech signal;

a gain signal comprising a representation of energy in the input speech signal;

receiving user selection of at least one of multiple voice fonts each specifying a manner of modifying at least one of the received signals;

modifying at least one of the received signals as specified by the selected voice font;

providing an output of the received signals incorporating said modifications.

2. The method of claim 1, wherein the modifying operation comprises modifying the formants signal by performing operations comprising:

converting linear predictive coding coefficients of the formants signal to linear spectral pairs;

modifying the linear spectral pairs as specified by the selected voice font;

converting the modified linear spectral pairs into linear predictive coding coefficients.

3. The method of claim 1, the modifying operation comprising modifying the pitch signal by performing operations comprising one of the following:

multiplying the pitch signal by a predetermined coefficient;

multiplying the pitch signal by a matrix of differential coefficients over time;

replacing the pitch signal with a fixed pitch pattern of one or more levels.

4. The method of claim 1, the modifying operation comprising normalizing the gain signal to a fixed value.

5. The method of claim 1, the modifying operation comprising changing the voicing signal to a different value of voiced, unvoiced, or mixed.

6. The method of claim 1, each voice font further specifying a filter type, the operations further comprising:

filtering the output as specified by the selected voice font.

7. The method of claim 1, the modifying operation comprising:

applying a first conversion to the formants signal;

applying a second conversion, different than the first conversion, to the pitch signal.

8. A method of processing speech, comprising operations of:

applying linear predictive coding to input speech to yield a formants output and a residual output;

processing the residual output to yield respective outputs representing pitch, gain, and voicing of the input speech;

receiving user selection of at least one of multiple predetermined voice fonts each specifying a manner of modifying at least one of the formants, pitch, gain, and voicing outputs, and modifying one or more of the formants, pitch, gain, and voicing outputs according to the selected voice font;

recombining the formants, pitch, gain, and voicing outputs including any modifications to form a decoded output signal.

9. A signal-bearing medium tangibly embodying a program of machine-readable instructions executable by a digital processing apparatus to perform speech conversion operations comprising:

receiving signals including:

a formants signal representative of an input speech signal;

a voicing signal comprising an indication of whether the input speech signal is voiced, unvoiced, or mixed;

a pitch signal comprising a representation of fundamental frequency of the input speech signal;

a gain signal comprising a representation of energy in the input speech signal;

receiving user selection of at least one of multiple voice fonts each specifying a manner of modifying at least one of the received signals;

modifying at least one of the received signals as specified by the selected voice font;

providing an output of the received signals incorporating said modifications.

10. The medium of claim 9, wherein the modifying operation comprises modifying the formants signal by performing operations comprising:

converting linear predictive coding coefficients of the formants signal to linear spectral pairs;

modifying the linear spectral pairs as specified by the selected voice font;

converting the modified linear spectral pairs into linear predictive coding coefficients.

11. The medium of claim 9, modifying operation comprising modifying the pitch signal by performing operations comprising one of the following:

multiplying the pitch signal by a predetermined coefficient;

multiplying the pitch signal by a matrix of differential coefficients over time;

replacing the pitch signal with a fixed pitch pattern of one or more levels.

12. The medium of claim 9, the modifying operation comprising normalizing the gain signal to a fixed value.

13. The medium of claim 9, the modifying operation comprising changing the voicing signal to a different value of voiced, unvoiced, or mixed.

14. The medium of claim 9, each voice font further specifying a filter type, the operations further comprising:

filtering the output as specified by the selected voice font.

15. The medium of claim 9, the modifying operation comprising:

applying a first conversion to the formants signal;

applying a second conversion, different than the first conversion, to the pitch signal.

16. A signal-bearing medium tangibly embodying a program of machine-readable instructions executable by a digital processing apparatus to perform speech conversion operations comprising:

applying linear predictive coding to input speech to yield a formants output and a residual output;

processing the residual output to yield respective outputs representing pitch, gain, and voicing of the input speech;

receiving user selection of at least one of multiple predetermined voice fonts each specifying a manner of modifying at least one of the formants, pitch, gain, and voicing outputs, and modifying one or more of the formants, pitch, gain, and voicing outputs according to the selected voice font;

recombining the formants, pitch, gain, and voicing outputs including any modifications to form a decoded output signal.

17. Circuitry of multiple interconnected electrically conductive elements configured to perform speech conversion operations comprising:

receiving signals including:

a formants signal representative of an input speech signal;

a voicing signal comprising an indication of whether the input speech signal is voiced, unvoiced, or mixed;

a pitch signal comprising a representation of fundamental frequency of the input speech signal;

a gain signal comprising a representation of energy in the input speech signal;

receiving user selection of at least one of multiple voice fonts each specifying a manner of modifying at least one of the received signals;

modifying at least one of the received signals as specified by the selected voice font;

providing an output of the received signals incorporating said modifications.

18. The circuitry of claim 17, wherein the modifying operation comprises modifying the formants signal by performing operations comprising:

converting linear predictive coding coefficients of the formants signal to linear spectral pairs;

modifying the linear spectral pairs as specified by the selected voice font;

converting the modified linear spectral pairs into linear predictive coding coefficients.

19. The circuitry of claim 17, the modifying operation comprising modifying the pitch signal by operations comprising one of the following:

multiplying the pitch signal by a predetermined coefficient;

multiplying the pitch signal by a matrix of differential coefficients over time;

replacing the pitch signal with a fixed pitch pattern of one or more levels.

20. The circuitry of claim 17, the modifying operation comprising normalizing the gain signal to a fixed value.

21. The circuitry of claim 17, the modifying operation comprising changing the voicing signal to a different value of voiced, unvoiced, or mixed.

22. The circuitry of claim 17, each voice font further specifying a filter type, the operations further comprising:

filtering the output as specified by the selected voice font.

23. The circuitry of claim 17, the modifying operation comprising:

applying a first conversion to the formants signal;

applying a second conversion, different than the first conversion, to the pitch signal.

24. Circuitry of multiple interconnected electrically conductive elements configured to perform speech conversion operations comprising:

applying linear predictive coding to input speech to yield a formants output and a residual output;

processing the residual output to yield respective outputs representing pitch, gain, and voicing of the input speech;

receiving user selection of at least one of multiple predetermined voice fonts each specifying a manner of modifying at least one of the formants, pitch, gain, and voicing outputs, and modifying one or more of the formants, pitch, gain, and voicing outputs according to the selected voice font;

recombining the formants, pitch, gain, and voicing outputs including any modifications to form a decoded output signal.

25. A wireless communications device, comprising:

a transceiver coupled to an antenna;

a speaker;

a microphone;

a user interface;

a manager coupled to components including the transceiver, speaker, microphone, and user interface to manage operation of the components, the manager including a speech conversion system configured to perform operations comprising:

receiving signals including:

a formants signal representative of an input speech signal;

a voicing signal comprising an indication of whether the input speech signal is voiced, unvoiced, or mixed;

a pitch signal comprising a representation of fundamental frequency of the input speech signal;

a gain signal comprising a representation of energy in the input speech signal;

receiving user selection of at least one of multiple voice fonts each specifying a manner of modifying at least one of the received signals;

modifying at least one of the received signals as specified by the selected voice font;

providing an output of the received signals incorporating said modifications.

26. A wireless communications device, comprising:

a transceiver coupled to an antenna;

a speaker;

a microphone;

a user interface;

a manager coupled to components including the transceiver, speaker, microphone, and user interface to manage operation of the components, the manager including a speech conversion system configured to perform operations comprising:

applying linear predictive coding to input speech to yield a formants output and a residual output;

processing the residual output to yield respective outputs representing pitch, gain, and voicing of the input speech;

receiving user selection of at least one of multiple predetermined voice fonts each specifying a manner of modifying at least one of the formants, pitch, gain, and voicing outputs, and modifying one or more of the formants, pitch, gain, and voicing outputs according to the selected voice font;

recombining the formants, pitch, gain, and voicing outputs including any modifications to form a decoded output signal.

27. A wireless communications device, comprising:

an encoder, including a linear predictive coding (LPC) analyzer coupled to a voicing detector, a pitch searcher, and a gain calculator;

a speech conversion module including a formants modifier in communication with the LPC analyzer, a voicing modifier in communication with the voicing detector, a pitch modifier in communication with the pitch searcher, a gain modifier in communication with the gain calculator, and a voice fonts library in communication with all of the modifiers;

a decoder comprising an excitation signal generator in communication with the voicing modifier, the pitch modifier, and the gain modifier, the decoder also including an LPC synthesizer coupled to the excitation signal generator.

28. A speech conversion system, comprising:

a transceiver coupled to an antenna;

a speaker;

a microphone;

a user interface;

means for managing operation of the transceiver, speaker, microphone, and user interface and additionally including means for speech conversion by:

receiving signals including:

a formants signal representative of an input speech signal;

a voicing signal comprising an indication of whether the input speech signal is voiced, unvoiced, or mixed;

a pitch signal comprising a representation of fundamental frequency of the input speech signal;

a gain signal comprising a representation of energy in the input speech signal;

receiving user selection of at least one of multiple voice fonts each specifying a manner of modifying at least one of the received signals;

modifying at least one of the received signals as specified by the selected voice font;

providing an output of the received signals incorporating said modifications.

29. A wireless communications device, comprising:

a transceiver coupled to an antenna;

a speaker;

a microphone;

a user interface;

means for managing the transceiver, speaker, microphone, and user interface and additionally including means for speech conversion by:

applying linear predictive coding to input speech to yield a formants output and a residual output;

processing the residual output to yield respective outputs representing pitch, gain, and voicing of the input speech;

receiving user selection of at least one of multiple predetermined voice fonts each specifying a manner of modifying at least one of the formants, pitch, gain, and voicing outputs, and modifying one or more of the formants, pitch, gain, and voicing outputs according to the selected voice font;

recombining the formants, pitch, gain, and voicing outputs including any modifications to form a decoded output signal.

30. A wireless communications device, comprising:

means for encoding comprising means for linear predictive coding (LPC) analyzing and, coupled to the means for LPC analyzing, means for voicing detection, means for pitch searching, and means for gain calculation;

means for speech conversion including means for modifying formants coupled to the means for LPC analyzing, means for voicing modification coupled to the means for voicing detection, means for modifying pitch in communication with the means for pitch searching, means for modifying gain in communication with the means for gain calculation, and a voice fonts library;

decoder means comprising means for LPC synthesizing and, coupled to the means for LPC synthesizing, means for excitation signal generation additionally coupled to the means for voicing modification, the means for pitch modification, and the means for gain modification.

* * * * *